US005609437A

United States Patent [19]

Silva

[11] Patent Number: 5,609,437

[45] Date of Patent: Mar. 11, 1997

[54] CONCRETE SCREED

[76] Inventor: Steve Silva, 10141 Gerber Rd., Sacramento, Calif. 95829

[21] Appl. No.: 531,472

[22] Filed: Sep. 21, 1995

[51] Int. Cl.[6] ..... E01C 19/44

[52] U.S. Cl. ..... 404/118; 404/97; 404/119; 15/235.4

[58] Field of Search ..... 404/101, 118, 404/119, 96, 97; 15/235.4, 235.5, 235.8, 245

[56] References Cited

U.S. PATENT DOCUMENTS

| | | | |
|---|---|---|---|
| 1,227,308 | 5/1917 | Plank | 15/235.5 |
| 1,586,325 | 5/1926 | Older . | |
| 1,887,195 | 11/1932 | Joy . | |
| 1,929,666 | 10/1933 | Tullis . | |
| 2,306,671 | 12/1942 | Tamblyn . | |
| 2,952,028 | 9/1960 | Robbins | 15/235.4 |
| 4,449,845 | 5/1984 | Carrillo . | |
| 4,641,995 | 2/1987 | Owens . | |
| 4,702,641 | 10/1987 | Naser et al. . | |
| 5,324,085 | 6/1994 | Hintz, Jr. . | |
| 5,393,168 | 2/1995 | Jarvis | 404/97 |
| 5,467,496 | 11/1995 | Jarvis | 404/97 X |

*Primary Examiner*—James A. Lisehora
*Attorney, Agent, or Firm*—John P. O'Banion

[57] ABSTRACT

A concrete screed which includes an elongated rail and a detachable shoe with a screeding surface. The shoe reversibly snap fits or slides onto the rail, and may be replaced when the screeding surface becomes worn. The rail includes hand grips for hand operation, and a hole in which a handle, pole, or hook may be inserted for pulling or pushing the screed. Screed rail supports may be attached to the elongated rail to allow the screed to be pulled over screed rails while screeding.

14 Claims, 3 Drawing Sheets

CONCRETE SCREED

BACKGROUND OF THE INVENTION

1. Field of the Invention

The present invention pertains generally to devices and methods for smoothing or working concrete and cement, and more particularly to a lightweight concrete screed with a removable and interchangeable screeding edge for providing a smooth finish to concrete and the like.

2. Description of the Background Art

Smoothing or leveling of concrete surfaces is frequently required in the construction of residential, commercial, and other types of buildings and structures. A concrete screed is generally used for screeding freshly poured concrete to provide smooth and level surfaces for floors and the like. Frequently, a simple piece of lumber with a smooth surface, such as a "2 by 4", is employed as a screed, and is drawn or pulled across a wet concrete surface by one or more persons in order to level the surface. Concrete screeding is a difficult and labor-intensive operation which must be carried out quickly before the poured concrete sets up, and once the concrete has hardened, errors or defects in the concrete surfaces generally cannot be corrected.

To facilitate concrete screeding, a variety of screed devices have been developed. For example, U.S. Pat. No. 5,324,085 discloses a concrete screed handle assembly wherein a U-shaped tubular bar contains clamping points which accommodate a screed board. U.S. Pat. No. 4,702,641 discloses a multi-purpose concrete working tool having a long blade with sharp edges coupled to a handle and lateral braces. U.S. Pat. No. 4,641,995 discloses a user-mounted concrete screed in which a screed plate with a vibrator is harnessed to an operator. U.S. Pat. No. 4,449,845 discloses a screed board apparatus wherein a screed board is harnessed to an operator and controlled by handles. U.S. Pat. No. 2,306,671 discloses a concrete screed and guide in which a smoothing blade is slidably mounted on runners. U.S. Pat. No. 1,929,660 discloses a method of making a road tool which employs an elongated smooth body joined to a handle. U.S. Pat. No. 1,887,195 discloses a means for surfacing sand and the like wherein a bar is supported between two rolling supports. U.S. Pat. No. 1,586,325 discloses a device for smoothing the surface of concrete pavements in which a platform or float is drawn across concrete surfaces by a wheeled carrier.

As can be seen therefore, several concrete smoothing or leveling devices are known. However, a number of deficiencies are present in these conventional devices. For example, such devices are generally heavy and tiresome to operate. Particularly, wooden screed boards are heavy and cumbersome, and devices for holding screed boards do not alleviate the weight of such boards. Efforts to provide screeding devices of reduced weight have tended to rely on thin, blade-like screeds which can warp or twist during use, making the screeds difficult to use and resulting in uneven concrete surfaces. Another drawback experienced in many devices is that the screed surface, which becomes abraded and worn during repeated use with rough concrete, is difficult to replace or cannot be replaced at all. Ultimately, the screed surface may become so worn that it can no longer provide smooth surfaces to concrete, and the entire screed must be discarded.

Thus, there is a need for a concrete screed which is lightweight and easy to use, which is rigid and durable and does not bend or warp during use, and which has an easily replaceable screed surface. The present invention satisfies these needs, as well as others, and generally overcomes the deficiencies found in the background art.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains to a rigid and lightweight concrete screed having an interchangeable screeding edge or surface. In general terms, the invention comprises an elongated, generally rectangular rail, a removable and replaceable screed shoe with a screeding surface, means for reversibly coupling the screed shoe to the rail, and means for attaching a hook or pole to the screed.

By way of example and not of limitation, the rail is of lightweight construction and preferably comprises a foam core and a durable, rigid exterior shell. Hand gripping means are generally provided on the rail, and preferably comprise longitudinal, concave hand and finger grips which extend between the ends of the rail. The reversible coupling means for the removable and replaceable screed shoe preferably comprises means for snapping or sliding the screed shoe onto a bottom surface or edge of the rail. Means for attaching to a hook or handle are included on the rail to allow pulling or pushing of the screed apparatus. Means for attaching guiding supports to the rail are also provided, and preferably comprise vertically protruding bolts adjacent to the ends of the rail for attachment of guiding supports for guiding or steering the screed over concrete forms. An object of the invention is to provide a concrete screed which is lightweight and easy to use.

Another object of the invention is to provide a concrete screed which is rigid and durable and which will not undergo warping or bending during use.

Another object of the invention is to provide a concrete screed which includes an interchangeable screeding edge or surface which can be replaced when worn or ragged.

Another object of the invention is to provide a concrete screed which includes hand grips for direct hand use as well as means for attaching to a pole or handle.

Another object of the invention is to provide a concrete screed which includes removable screed rail guides.

Further objects of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
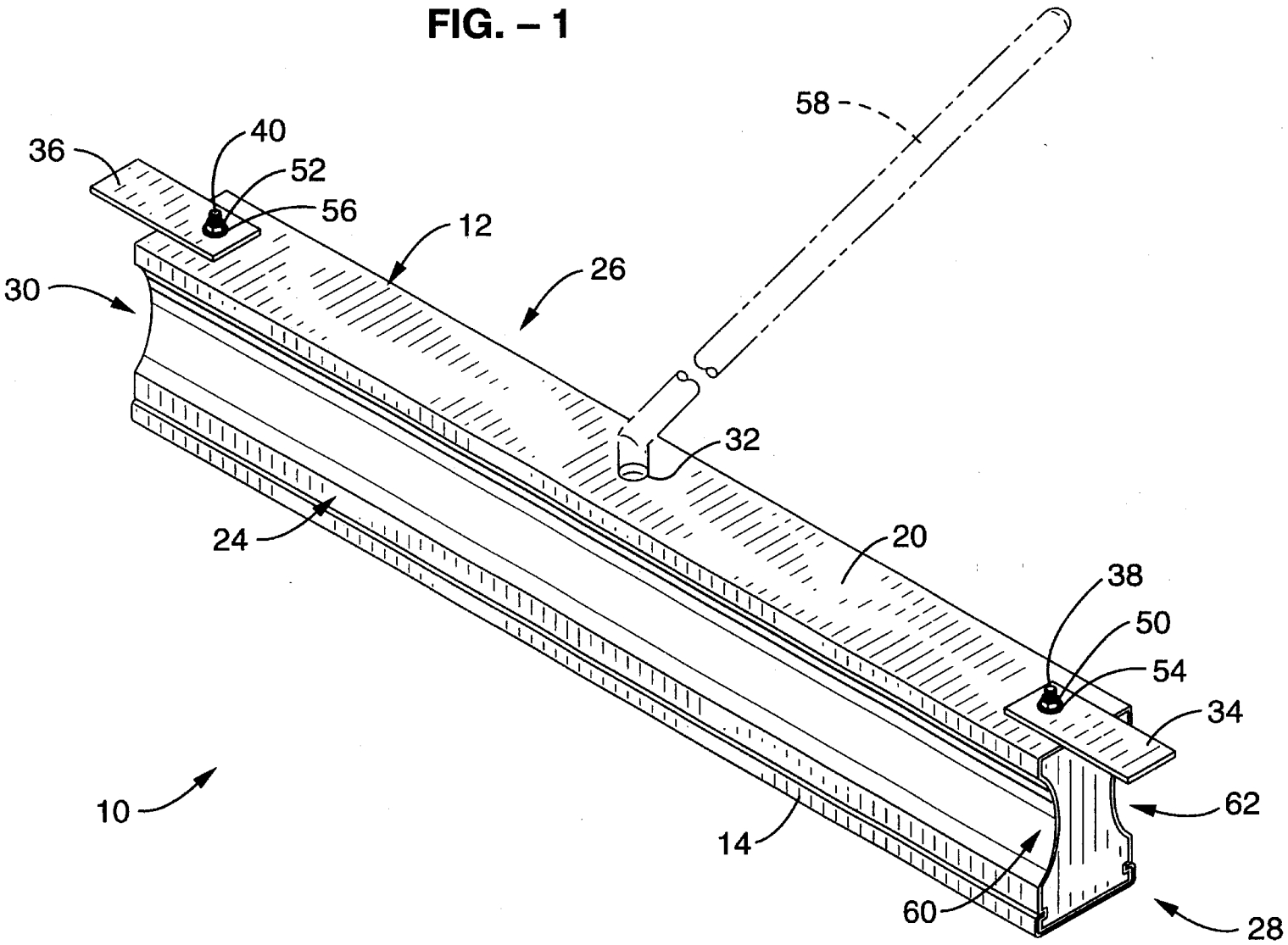
FIG. 1 is a perspective view of a concrete screed shown in accordance with the present invention.
Figure 2:
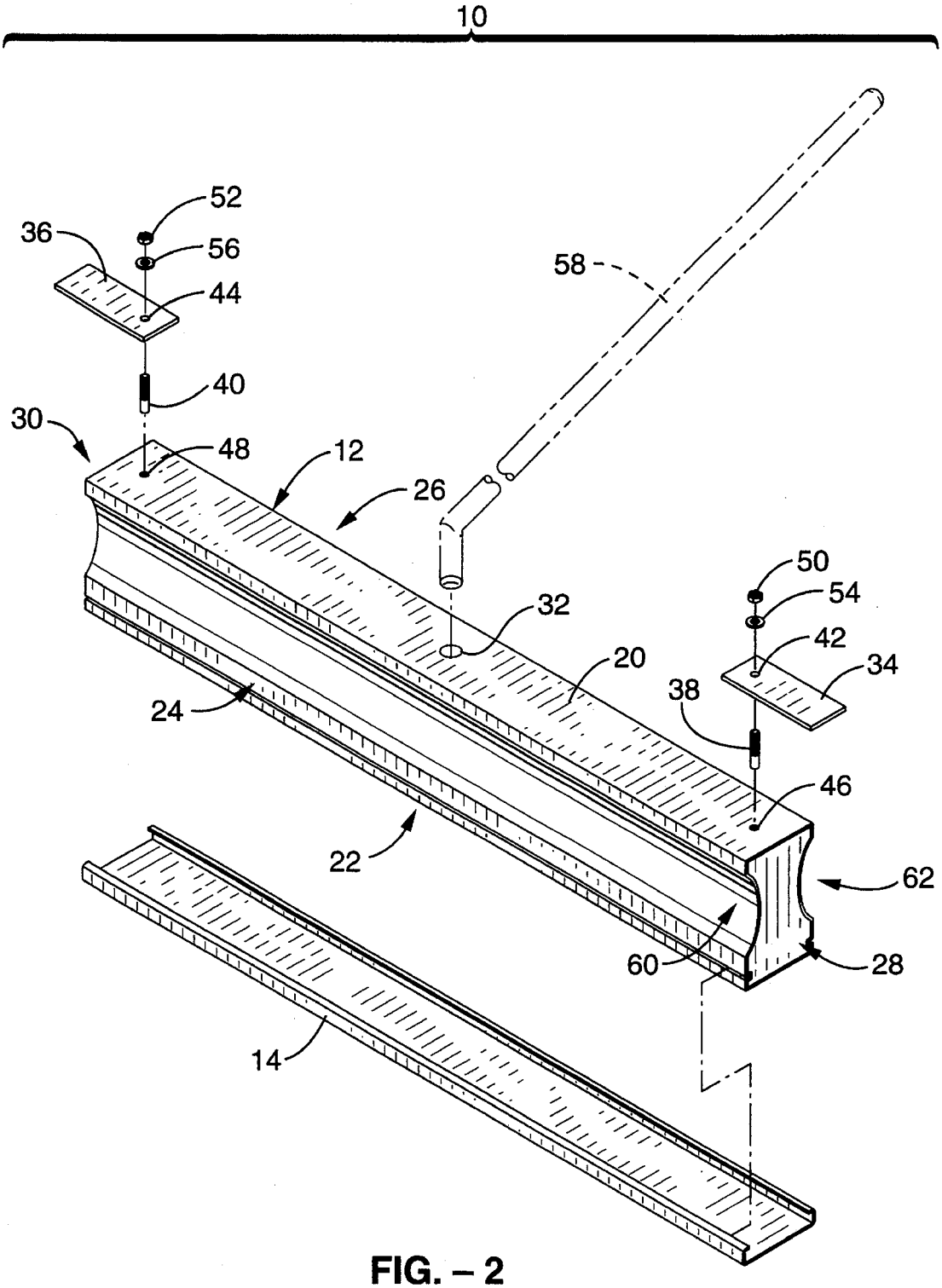
FIG. 2 is an exploded view of the concrete screed shown in FIG. 1.
Figure 3:
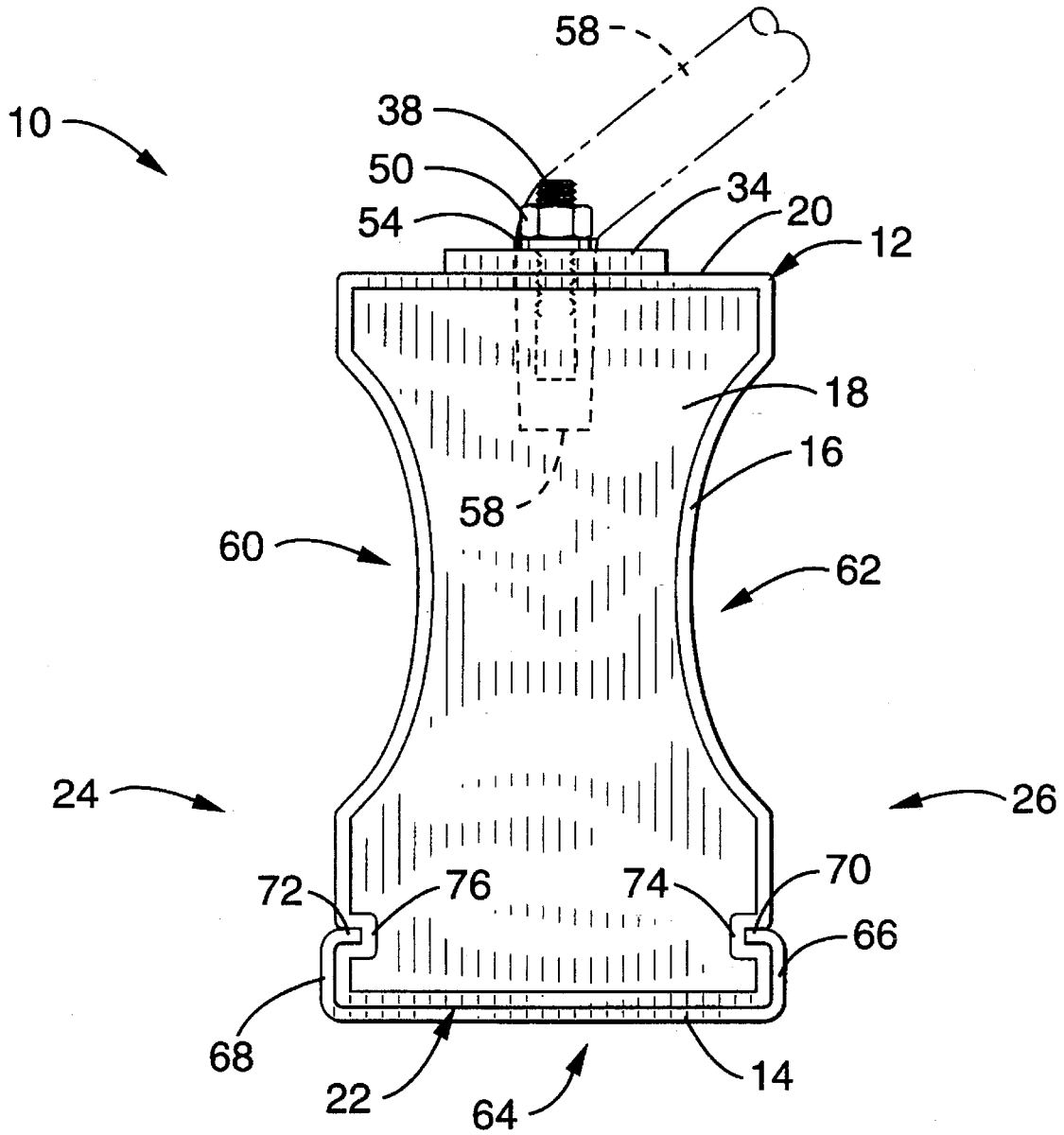
FIG. 3 is an end view of the concrete screed shown in FIG. 1.

Referring more specifically to the drawings, for illustrative purposes the present invention is embodied in the apparatus which is generally shown in FIG. 1 through FIG. 3. It will be appreciated that the apparatus may vary as to configuration and as to details without departing from the basic concepts as disclosed herein.

Referring now to FIG. 1 through FIG. 3, there is depicted a concrete screed 10 in accordance with the present invention. The concrete screed 10 generally includes an elongated rail or screed member 12, and a removable and replaceable screed shoe 14. Rail 12 is preferably of light weight construction, comprising a rigid, durable, light weight exterior shell 16 (FIG. 3), and a light weight foam core 18 (FIG. 3) within exterior shell 16. Exterior shell 16 is preferably made of composite material, which may be, for example, glass or carbon fiber reinforced resin such as a polyester or a fiber-reinforced engineering resin such as polyether sulfone, polyphenylene sulfide (PPS), polyetherether ketone (PEEK), or liquid crystal polyester (LCP). Exterior shell 16 may also be fabricated from neat resin having suitable characteristics. Foam core 18 is preferably made of a rigid, light weight polyurethane or polystyrene foam, or other like polymeric foam material.

Rail 12 may be of any length or shape useful for screeding concrete, and may vary as to length and shape in order to meet requirements for particular screeding operations. In the preferred embodiment, rail 12 is of generally rectangular cross section, and generally includes a top edge or surface 20, a bottom edge or surface 22, a first side 24, and a second side 26. Rail 12 also generally includes a first end 28 and a second end 30. Means for attaching a handle, pole, hook, or cable are preferably included adjacent the top edge or surface 20 of rail 12, to facilitate pulling or pushing of screed 10 by a person. The attaching means preferably comprises a hole or bore 32 centrally located in top edge or surface 20. Hole 32 is preferably of ½ diameter with a metal sleeve (not shown), which may be threaded or otherwise configured to accommodate standard, commercially available handles and poles. Hole 32 may alternatively be included on first or second side 24, 26 adjacent to top edge 20. It is also contemplated that a hook (not shown) attached to a cable or rope could be engaged in hole 32 or attached to rail 12 by like means, to aid a user in pulling screed 10. The handle attachment means may alternatively comprise an eyebolt, slot, or other means which allow attachment of a handle, hook or pole to rail 12.

Also included are screed rail supports 34, 36 in the form of rectangular plates or the like which extend laterally out over ends 28, 30 respectively of rail 12 to permit the apparatus 10 to be supported on screed rails or forms used while screeding concrete surfaces. The means for attaching screed rail supports 34, 36 preferably comprises a pair of upwardly disposed bolts or threaded studs 38, 40. Screed rail supports 34, 36 are mounted onto rail 12 using bolts 38, 40, which extend through holes 42, 44 in screed rail supports 34, 36 respectively, and engage bores 46, 48 in rail top surface 20. Screed rail supports 34, 26 are secured in place using nuts 50, 52, and washers 54, 56. Other attachment means for guiding supports are also contemplated for use with the invention, including bores, clips, clamps and like means commonly used in the art.

Rail 12 also preferably includes means for hand gripping so that a person may operate the screed 10 by directly handling rail 12. In the preferred embodiment, the hand gripping means comprises first and second longitudinal channels 60, 62 on first and second sides 24, 26 respectively of rail 12, with channels 60, 62 running between first and second ends 28, 30 along the length of rail 12. Channels 60, 62 are preferably concave in shape and generally structured and configured to accommodate a person's hands, as can be seen most clearly in FIG. 3. As also can seen from FIG. 3, first side 24 and second side 26 have upper and lower planar faces between which channels 60, 62 extend inward to define the concave shape of channels 60, 62. Alternatively, the hand gripping means may comprise a plurality of ridges, serrations, indents, detents, knurled surfaces or other traction generating means which accommodate a person's hands and generally aid in gripping and using the present invention. Also contemplated for hand gripping means are grips or bars which could be included adjacent top edge 20 or sides 24, 26 of rail 12.

Referring more particularly to FIG. 3, the removable or detachable screed shoe 14 is generally positioned adjacent bottom edge or surface 22 of rail 12. Screed shoe 14 includes a generally flat screeding surface 64, which preferably conforms in shape to bottom edge or surface 22. Screed shoe 14 attaches to rail 12 by reversible coupling means, which may comprise means for snapping or sliding screed shoe 14 onto rail 12 adjacent bottom edge 22. The reversible coupling means preferably comprises a pair of upwardly disposed longitudinal flanges 66, 68 on screed shoe 14, each of which includes an inwardly disposed lip 70, 72. The reversible coupling means also preferably comprises longitudinal slots 74, 76 on rail 12 which are structured and configured to reversibly engage lips 70, 72 by sliding or snap fitting. Slots 74, 76 are preferably included adjacent rail bottom edge 22 along rail first and second sides 24, 26, although such slots may alternatively be located on rail bottom edge 22. It is also contemplated that screed shoe 14 could be reversibly coupled to rail 12 by other coupling means, such as a plurality of protrusions which snap fit into a corresponding plurality of matching indentations. The protrusions and indentations could be included on either rail 12 or screed shoe 14, or both. Clips, clamps, screw fasteners, and like reversible coupling means commonly used in the art may also be employed for attaching screed shoe 14 to rail 12. The coupling means may be included on bottom surface 22 as well as sides 24, 26 of rail 12.

The present invention is utilized, in its simplest form, by snapping or sliding screed shoe 14 onto rail 12 by engaging lips 70, 72 in slots 74, 76, so that smooth screeding surface 64 is facing downward. Concrete screed 10 is then employed by manually grasping rail 12, using channels 60, 62 to accommodate the user'fingers and thumb, and drawing the concrete screed 10 across wet concrete surfaces. Concrete screed 10 may also be used on sand and other materials requiring grading, smoothing or leveling. Pole or handle 58 may be used to push, pull, or otherwise draw concrete screed 10. In some concrete screeding operations, it will be desirable to screed rail supports along which screed 10 may be drawn. Screed 10 would then be drawn in a straight line between the screed rails while supported by the screed rail supports 34, 36, thereby facilitating the concrete screeding operation. A rope, cable, or a plurality of ropes or cables, as well as pole 58, may be attached by hook or other means to rail 12 to aid in drawing screed 10 along guiding rails. Vibrating means such as an electric motor may be attached to rail 12 to provide a vibrating action to facilitate screeding.

The lightweight nature of the present invention makes it use less tiresome than use of conventional devices. The rigid composite exterior and foam core prevent bending or warping during use, as generally occurs in screed devices which have sacrificed rigidity and durability to reduce weight of the screed. When screeding surface 48 on screed shoe 14 becomes worn or ragged, screed shoe 14 can be removed by disengaging lips 70, 72 from slots 74, 74 and replacing with a new screed shoe 14. Screeding surface 64 could include a plurality of teeth or other features to impart particular textures to screeded concrete.

Accordingly, it will be seen that the present invention provides a light weight concrete screed which is rigid and durable, which has a replaceable screeding edge, and which includes both hand gripping means and means for attaching to a pole or other handle. Although the description above contains many specificities, these should not be construed as limiting the scope of the invention but as merely providing illustrations of the presently preferred embodiment of this invention. Thus, the scope of the invention should be determined by the appended claims and their legal equivalents.

What is claimed is:

1. A concrete screed, comprising:

(a) an elongated rail, said rail including a bottom edge, a top edge, a first side, and a second side, each said side having upper and lower planar faces;

(b) a removable shoe, said shoe including a screeding surface;

(c) means for reversibly coupling said shoe to said rail adjacent to said bottom edge of said rail;

(d) a first longitudinal concave channel positioned in said first side of said rail; and (e) a second longitudinal concave channel positioned in said second side of said rail, wherein each said channel is positioned between said top edge and said bottom edge of said rail and extends inward from said upper and lower planar faces of said rail.

2. A concrete screed as recited in claim 1, wherein said rail comprises a lightweight foam core surrounded by a lightweight exterior shell.

3. A concrete screed as recited in claim 1, further comprising:

(a) a plurality of screed rail supports; and (b) means for attaching said screed rail supports to said rail.

4. A concrete screed as recited in claim 1, wherein said reversible coupling means comprises means for reversibly snap-fitting said shoe onto said rail adjacent said bottom surface of said rail.

5. A concrete screed as recited in claim 1, wherein said reversible coupling means comprises means for reversibly sliding said shoe onto said rail adjacent said bottom surface of said rail.

6. A concrete screed as recited in claim 1, further comprising means for attaching a handle to said rail, said handle attaching means included adjacent said top edge of said rail.

7. A concrete screed, comprising:

(a) an elongated rail, said rail including a top edge and a bottom edge, said rail including a first side and a second side, said rail including a first end and a second end;

(b) a removable shoe, said shoe including a screeding surface;

(c) first and second longitudinal slots, said slots included on said rail adjacent said bottom edge of said rail;

(d) first and second upwardly disposed longitudinal flanges, said flanges included on said shoe, each of said flanges including an inwardly disposed lip, said lips on said flanges structured and configured to reversibly engage said slots on said rail; and (e) means for grasping said rail by a user.

8. A concrete screed as recited in claim 7, wherein said rail comprises a lightweight foam core surrounded by a lightweight exterior shell.

9. A concrete screed as recited in claim 7, further comprising:

(a) a plurality of screed rail supports; and (b) means for attaching said screed rail supports to said rail.

10. A concrete screed as recited in claim 7, wherein said grasping means comprises first and second longitudinal concave channels positioned in said first and second sides of said rail, respectively.

11. A concrete screed as recited in claim 7, wherein said shoe snap-fits onto said rail.

12. A concrete screed as recited in claim 7, wherein said shoe slides onto said rail.

13. A concrete screed as recited in claim 7, further comprising means for attaching a handle to said rail, said handle attaching means included adjacent said top edge of said rail.

14. A concrete screed, comprising:

(a) an elongated rail, said rail including a top surface and a bottom surface, said rail including a first side and a second side, said rail including a first end and a second end, said rail including a lightweight foam core, said rail including a lightweight exterior shell surrounding said foam core;

(b) a removable screed shoe, said screed shoe including a screeding surface parallel to said bottom surface of said rail;

(c) a first concave channel positioned in said first side of said rail;

(d) a second concave channel positioned in said second side of said rail;

(e) means for attaching a handle to said rail, said handle attaching means included adjacent said top edge of said rail; and (f) means for supporting said rail on screed rails;

(g) a first longitudinal slot positioned in said first side of said rail adjacent to said bottom surface of said rail;

(h) a second longitudinal slot positioned in said second side of said rail adjacent to said bottom surface of said rail; and (h) first and second upwardly disposed longitudinal flanges, said flanges included on said shoe, each of said flanges including an inwardly disposed lip, said lips on said flanges structured and configured to reversibly engage said slots in said rail.

* * * * *